United States Patent [19]

Sakazume et al.

[11] 4,134,767

[45] Jan. 16, 1979

[54] SILVER HALIDE PHOTOSENSITIVE MATERIAL FOR COLOR PHOTOGRAPHY

[75] Inventors: Kaiichiro Sakazume, Hino; Noboru Fujimori, Hino; Eiichi Sakamoto, Hino; Hidehiko Ishikawa, Odawara, all of Japan

[73] Assignee: Konishiroku Photo Industry Co., Ltd., Tokyo, Japan

[21] Appl. No.: 781,668

[22] Filed: Mar. 28, 1977

Related U.S. Application Data

[63] Continuation of Ser. No. 706,768, Jul. 19, 1976, abandoned, which is a continuation of Ser. No. 517,049, Oct. 22, 1974, abandoned.

[30] Foreign Application Priority Data

Oct. 22, 1973 [JP] Japan ..... 48-117808

[51] Int. Cl.$^2$ ..... G03C 5/32; G03C 1/10; G03C 1/18

[52] U.S. Cl. ..... 96/60 R; 96/60 BF; 96/127; 96/135

[58] Field of Search ..... 96/135, 127, 60 R, 60 BF, 96/22

[56] References Cited

U.S. PATENT DOCUMENTS

| | | | |
|---|---|---|---|
| 3,511,664 | 5/1970 | Nakazawa et al. | 96/127 |
| 3,820,997 | 6/1974 | Shirasu et al. | 96/60 R |
| 3,822,129 | 7/1974 | Dunn et al. | 96/60 R |
| 3,822,135 | 7/1974 | Sakai et al. | 96/127 |

OTHER PUBLICATIONS

"Photographic Processing Chemistry" by Mason, 1966, pp. 211, 265.

*Primary Examiner*—Mary F. Kelley
*Attorney, Agent, or Firm*—Bierman & Bierman

[57] ABSTRACT

A method of bleaching an imagewise exposed and then developed silver halide photosensitive material for color photography wherein said material contains a red sensitive silver halide emulsion layer having at least one of a particular group of compounds and treating said photosensitive material with a bleaching or bleach-fixing solution containing an organic metal chelate compound.

5 Claims, No Drawings

SILVER HALIDE PHOTOSENSITIVE MATERIAL FOR COLOR PHOTOGRAPHY

This application is a Rule 60 continuation of co-pending Ser. No. 706,768, filed on July 19, 1976 now abandoned which itself is a continuation application of Ser. No. 517,049, filed on Oct. 22, 1974 now abandoned and which claims the priority of Japanese patent application No. 117808/1973, filed on Oct. 22, 1973.

This invention relates to a silver halide photosensitive material for color photography which has no inhibiting activity to bleaching effect of a cleaching solution or bleaching-fixing solution at the color photographic processing. At the photographic processing of a silver halide photosensitive material for color photography, the exposed photosensitive material is developed by color developer and than a silver image obtained by reduction by the color development is generally bleached and removed by a bleaching solution. As the bleaching oxidant to be used in a bleaching solution, there are known inorganic oxidants such as red prussiate, dichromates and persulfates and organic metal chelate compounds such as iron salts of aminopolycarboxylic acids, especially an iron salt of tetraacetic acid (hereinafter referred to merely as EDTA iron complex salt).

Among these oxidants, red prussiate has a high oxidizing activity and is a typical instance of the conventional oxidant. However, this oxidant releases free cyanogen under actinic rays and its use is controlled for prevention of environmental pollution. Since a bleaching solution containing EDTA iron complex salt is outside of the regulation for prevention of environmental pollution and one-bath treatment is possible if a thiosulfate capable of dissolving a silver halide is incorporated in such bleaching solution containing EDTA iron complex salt to form a bleaching-fixing solution, use of the EDTA iron complex salt recently has attracted attention and is regarded as being important as a substitute for red prussiate. However, as compared with a red prussiate bleaching liquid, the bleaching solution containing EDTA iron complex salt is insufficient in the following points. When a conventional silver halide photosensitive material for color photography is employed, the bleaching effect is lower than the red prussiate bleaching solution, and hence, the bleaching time is long. Further, discoloration or color fog is readily formed in the finished image. Recently, development, bleaching, fixation and water-washing of silver halide photosensitive materials for color photography are conducted consistently by one processing apparatus system, and prolongation of the bleaching time causes a serious hindrance in the consistent processing. Therefore, water-soluble iodides disclosed in the specifications of French Pat. No. 1,284,492, British Pat. No. 926,569, etc., polyoxyethylene thioether compounds disclosed in the specifications of British Pat. No. 933,088 and U.S. Pat. No. 3,241,966, thiourea derivatives disclosed in Japanese Patent Publication No. 8506/70 and the specification of British Pat. No. 1,150,666, selenosemicarbazide and its derivatives disclosed in the specification of French Pat. No. 2,074,216, and onium compounds disclosed in the specification of Belgian Pat. No. 770,910 are used for improving the bleaching activity of EDTA iron complex salt bleaching solution. In methods using such activators, however, during the process of the continuous transfer type treatment of silver halide photosensitive materials for color photography, a bleaching solution containing a promoting compound such as mentioned above is mingled into other treating solutions, readily causing such troubles as color fog. Since this defect is brought about in methods using a bleaching solution in which a promotor or activator is incorporated to improve the bleaching activity of the bleaching solution at the step of processing of a silver halide photosensitive material for color photography, it is more effective to develop a technique of improving a photosensitive material per se so that it can readily be bleached by a bleaching solution containing EDTA iron complex salt. In general, a silver halide photosensitive material for color photography is formed by laminating on a support film a silver halide emulsion layer comprising a blue-sensitive layer, a green-sensitive layer and a red-sensitive layer.

As a result of various research works, we found that the main cause of a low bleaching activity and occurrence of color contamination or discoloration observed when a silver halide photosensitive material for color photography which is prepared is treated with a bleaching solution containing an iron salt of an aminopolycarboxylic acid represented by EDTA iron complex salt is the red-sensitive sensitizing dye contained in a red-sensitive cyan color-forming layer. The above trouble is observed in a negative silver halide photosensitive material for color photography comprising a red-sensitive cyan color-forming layer as the lowermost layer, and in the case of a photosensitive paper for color printing having a red-sensitive cyan color-forming layer as the uppermost layer, the bleaching-inhibiting activity of this layer has great influences on the lower magenta color-forming and yellow color-forming layers. Thus, the influence of the red-sensitive sensitizing dye contained in a red-sensitive cyan color-forming layer is very serious.

It is therefore a primary object of this invention to provide a silver halide photosensitive material for color photography, the properties of which are improved so that its bleaching can be performed with high efficiency and a clear color image free of color contamination or discoloration can be obtained, and a method of bleaching the photosensitive material.

This object can be attained by incorporating at least one of the compounds represented

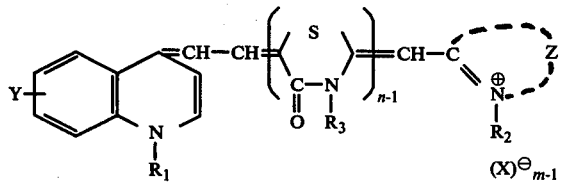

wherein $R_1$ and $R_2$ stand for a substituted or unsubstituted alkyl group, $R_3$ stands for an alkyl or allyl group, Y denotes a hydrogen or halogen atom or an alkyl or alkoxy group, Z denotes a group of atoms necessary for completion of a heterocyclic ring, X is an anion, m and n is an integer of 1 to 2 with the proviso that when m is 1, an internal salt is formed, into a red-sensitive cyan color-forming emulsion layer of a silver halide photosensitive material for color photography which is processed with a bleaching solution containing an organic metal chelate compound at the photographic processing.

More specifically, when a compound represented by the above general formula is incorporated in a red-sensitive cyan color-forming layer of a silver halide photosensitive material for color photography and this photosensitive material is treated with a bleaching solution containing an organic metal chelate compound such as EDTA iron complex salt at the photographic processing, the processing can be accomplished promptly for a very short time and a clear color image can be reproduced.

The organic metal chelate compound to be used for a bleaching solution in this invention includes chelate compounds in which a metal atom selected from the group consisting of iron, copper, cobalt and nickel is the central atom of the complex. Specific examples of such organic metal chelate compound are complexes of organic acids such as ethylenediamine tetraacetic acid, nitriloacetic acid, malonic acid, tartaric acid, maleic acid, fumaric acid, ethyliminodipropionic acid, ethylene dithioglycolic acid, dithioglycolic acid and citric acid with metal atoms such as iron, copper, cobalt and nickel.

In addition to such organic metal chelate compound, a bleaching assistant such as potassium bromide, sodium bromide, sodium chloride, ammonium bromide, ammonium chloride, potassium iodide or the like can be incorporated into the bleaching solution. Further, in order to use the bleaching solution as a bleaching-fixing liquid, it is possible to make sodium thiosulfate present in the bleaching liquid.

Typical instances of compounds represented by the above general formula, that can be preferably used in this invention are as follows:

(1)

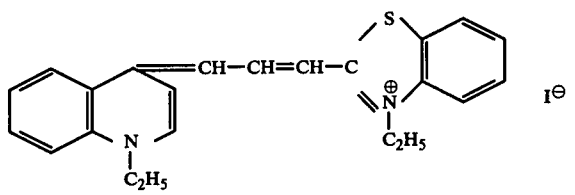

(2)

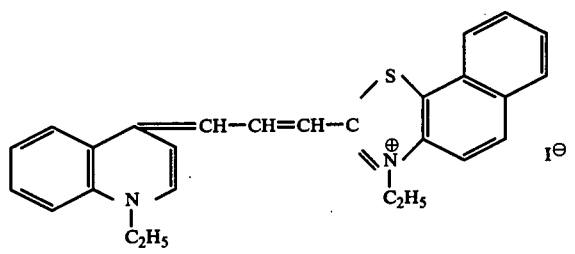

(3)

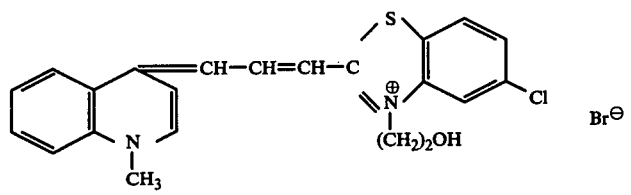

(4)

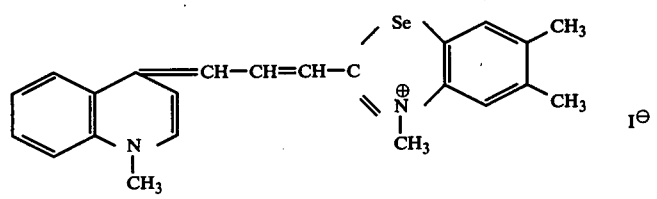

(5)

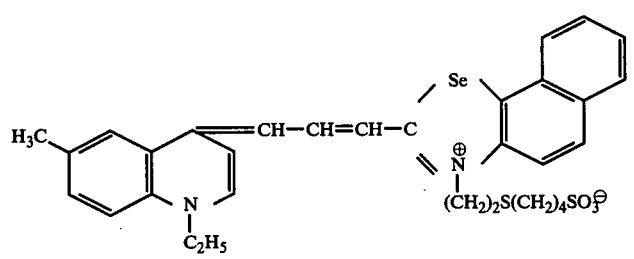

-continued
(6)
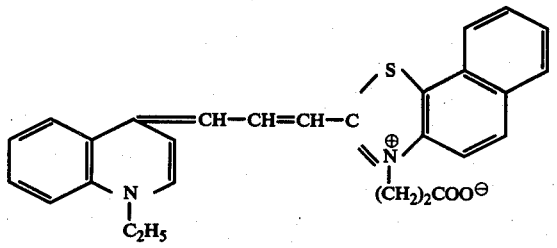
(7)
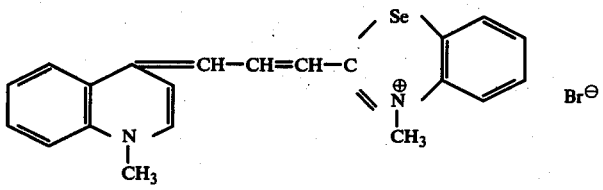
(8)
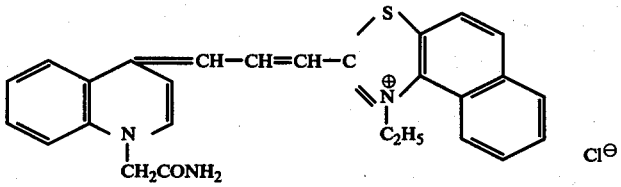
(9)
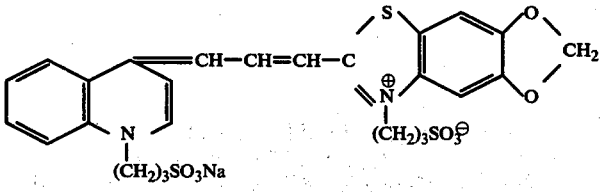
(10)
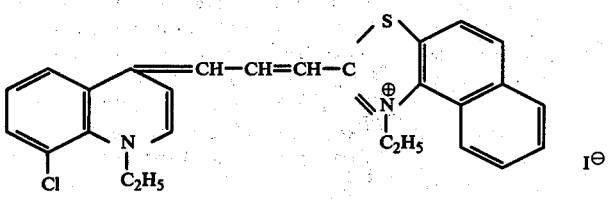
(11)
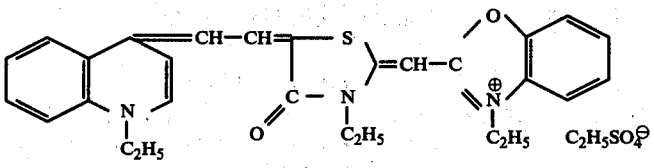
(12)
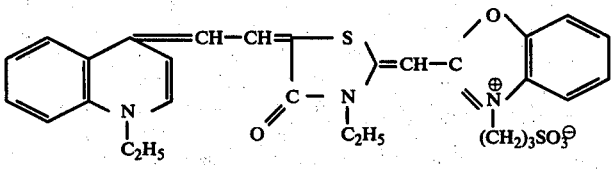
(13)
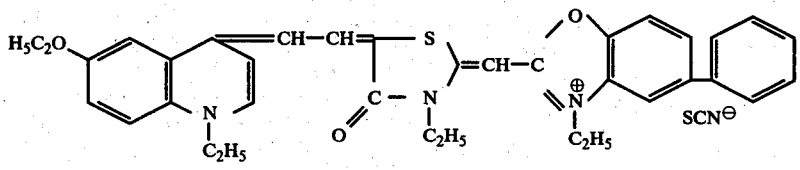

-continued (14)

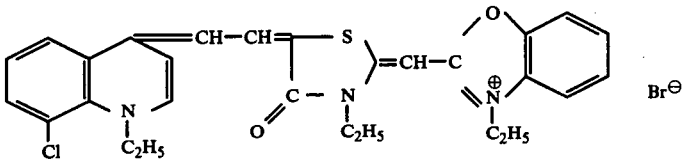

(15)

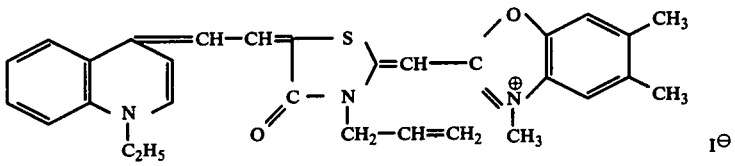

(16)

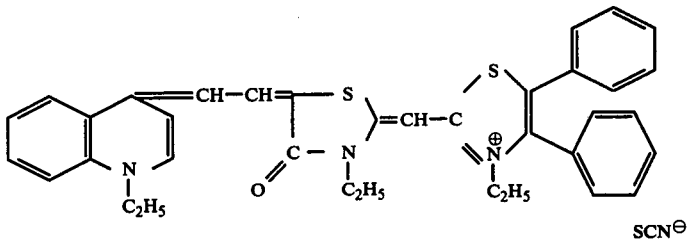

(17)

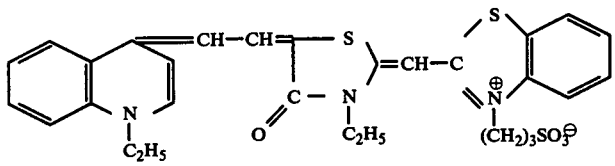

The compound of this invention represented by the above general formula is a carbocyanine or rhodacyanine dye having at least one quinoline hetero-ring nucleus in the chemical structure thereof and it is a red-sensitive sensitizing dye for photography having a sensitive wavelength region of from about 600 mμ to about 750 mμ. Although trimethine cyanine, pentamethine cyanine and merocyanine dyes, each of which has no quinoline hetero-ring, are red-sensitive sensitizing dyes having the above sensitive wavelength region, the above-mentioned effect of this invention cannot be attained by using these dyes.

Sensitizing dyes of this invention represented by the above general formula can easily be synthesized according to methods disclosed in literature references such as Report of Rikagaku Kenkyusho, 13, 549 (1934) and specifications of British Pat. No. 521,169, British Pat. No. 742,112, U.S. Pat. No. 2,213,238, U.S. Pat. No. 2,231,658, U.S. Pat. No. 2,503,776, U.S. Pat. No. 2,388,963, U.S. Pat. No. 2,442,710, U.S. Pat. No. 2,454,624 and U.S. Pat. No. 2,776,780.

Incorporation of the sensitizing dye of this invention into a silver halide photographic emulsion can be accomplished by dissolving it in a water-miscible organic solvent such as methyl alcohol or ethyl alcohol and adding the solution to the emulsion. The addition may be effected at any time during the emulsion-preparing process, but it is generally preferred that the addition is conducted just after completion of chemical ripening. The amount added of the sensitizing dye is varied depending on the kind of the sensitizing dye or the kind of the silver halide photographic emulsion, but it is generally added in an amount of 0.005 to 0.5 g per mole of the silver halide. Any of couplers customarily used for silver halide photographic emulsions can be used and the coupler may be either hydrophilic or oleophilic. Further, photographic additives such as anti-foggant, a tackifier, a coating aid, a film-hardner, a anti-staining agent, a anti-fading agent, a pH-adjusting agent and an anti-irradiation dye can be added according to known methods. Moreover, a fluorescent whitening agent such as a bistriazinylaminostilbene derivative, a super-sensitizing agent such as a novolak type condensate obtained by reaction between substituted or unsubstituted benzene and formaldehyde and a ultraviolet absorber such as a benztriazole can be made present together with the sensitizing dye of this invention.

This invention will now be illustrated in more detail by reference to the following Examples by no means limit the scope of this invention.

EXAMPLE 1

After completion of second ripening of a silver iodobromide emulsion prepared by a customary method, the emulsion was divided into 5 portions. No compound was added to one portion, and compounds of this invention shown in Table 1 were added to the remaining 4 portions respectively in the form of methyl alcohol solutions and made adsorbed sufficiently in the silver iodobromide. In each of the so formed 5 emulsions was incorporated and dispersed as a cyan coupler 2-[α-(2,5-di-tert-amylphenoxy)butylamido]-4,6-dichloro-5-methylphenol in an amount of 10% per mole of the silver halide, and each emulsion was uniformly coated on a film base to obtain 5 samples (samples Nos. 1 to 5). Then, each sample was exposed to light by a sensitometer of Model KS-1 (manufactured by konishoroku Photo Industry Co., Ltd.), and was then subjected to the following processing by using the following color developing, bleaching, fixing and stabilizing.

| Treatment Steps: | |
|---|---|
| Color developing | 3 minutes and 15 minutes |
| Bleaching | 5 minutes |
| Water washing | 3 minutes and 15 seconds |
| Fixing | 5 minutes |
| Water washing | 3 minutes and 15 seconds |
| Stabilizing | 1 minute and 30 seconds |
| Drying | |

| Composition of color Developing solution: | |
|---|---|
| Anhydrous sodium bicarbonate | 29.5 g |
| Potassium sulfite (dihydrate) | 3.5 g |
| Potassium bromide | 1.3 g |
| Sodium nitrilotriacetate (monohydrate) | 2.0 g |
| Potassium hydroxide | 0.4 g |
| Hydroxylamine sulfate | 2.0 g |
| 4-Amino-3-methyl-N-methyl-(β-hydroxyethyl) aniline sulfate | 5.0 g |
| Water | balance |
| Total | 1 liter |

| Composition of Bleaching Solution: | |
|---|---|
| Iron ammonium ethylenediamine tetraacetate | 100 g |
| Disodium ethylenediamine tetraacetate | 10 g |
| Ammonium bromide | 150 g |
| Glacial acetic acid | 10 ml |
| Water | balance |
| Total | 1 liter |

| Composition of Stabilizing Solution: | |
|---|---|
| Formalin (37% aqueous solution) | 1.5 ml |
| Tri-ethyleneglycol-t-octylphenoxy | 0.7 ml |
| Konidax (manufactured by Konishiroku Ethyleneglycol) | 6.8 ml |
| Water | balance |
| Total | 1 liter |

With respect to each of the so treated samples, the cyan dye image at the portion corresponding to the light wedge of a density of 1.0 used for the light exposure was decomposed with concentrated hydrochloric acid, and the density of the silver image left after the bleaching processing with the bleaching solution was determined to evaluate the bleaching efficiency. Obtained results are shown in Table 1.

TABLE 1

| Sample No. | Added Compound Kind | Added Compound Amount (mg/emulsion 1 kg) | Bleaching Efficiency (density of residual silver image) |
|---|---|---|---|
| 1 | — | — | 0.05 |
| 2 | Compound No. 7 | 20 | 0.03 |
| 3 | " | 50 | 0.02 |
| 4 | Compound No. 11 | 20 | 0.04 |
| 5 | " | 50 | 0.02 |

Generally, bleaching efficiency of a photosensitive material for color photography is degraded by incorporation of a sensitizing dye. From the results shown in Table 1, it will be readily understood that by addition of the compound of this invention, the density of the residual silver image after bleaching is reduced and the bleaching efficiency is rather imporoved.

EXAMPLE 2

A positive silver chlorobromide emulsion prepared according to a customary method was divided into 7 portions after second ripening thereof. No compound was incorporated into one portion, and the compounds of this invention shown in Table 2 and comparative compounds having a structure shown below were added to the remaining 6 portions, respectively and made adsorbed sufficiently in the silver chlorobromide.

Comparative Compound A:

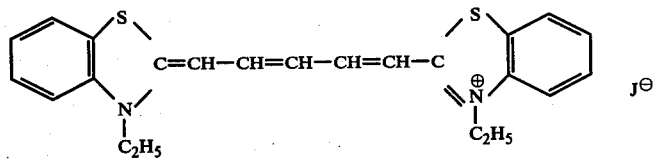

Comparative Compound B:

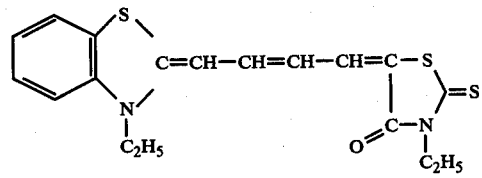

Into each of the so prepared 7 emulsions was incorporated as a cyan coupler 2-[α-(2,5-di-tert-amylphenoxy)-butylamido]-4,6-dichloro-5-methylphenol in an amount of 10% per mole of the silver halide, and each emulsion was unformly coated on a polyethylene-coated paper to obtain samples Nos. 6 to 10 and comparative samples Nos. 11 and 12. Each of these samples was light-exposed and subjected to the color development in the same manner as described in Example 1, and was processed with a bleaching-fixing solution having a composition shown below. The time required for bleaching completely the portion corresponding to the light wedge of a density of 1.0 used for the light exposure was measured and the obtained value was defined as the cleaning time, based on which the bleaching efficiency was evaluated. Obtained results are shown in Table 2.

Composition of Bleaching-Fixing Solution (treated at 30° C.):

| | |
|---|---|
| Disodium ethylenediamine tetraacetate | 5.0 g |
| Sodium ethylenediamine tetraacetate | 60.0 g |
| Anhydrous sodium sulfite | 15.0 g |
| Ammonium thiosulfate | 120.0 g |
| Sodium thiosulfate | 5.0 g |
| Water | balance |
| Total | 1 liter |

TABLE 2

| Sample No. | Compound Kind | Compound Amount Added (mg/kg emulsion) | Bleaching Efficiency (cleaning time, sec.) |
|---|---|---|---|
| 6 | — | — | 70 |
| 7 | Compound No. 1 | 40 | 60 |
| 8 | Compound No. 8 | 40 | 80 |
| 9 | Compound No. 13 | 40 | 70 |
| 10 | Compound No. 16 | 40 | 70 |
| 11 | Comparative Compound A | 40 | 120 |
| 12 | Comparative Compound B | 40 | 110 |

From the results shown in Table 2, it will readily be understood that in the case of the compound of this invention, the cleaning time is shorter than in the case of the comparative compounds and the compound of this invention has a much higher bleaching efficiency than the comparative compounds.

EXAMPLE 3

When the samples used in Example 2 were processed with a bleaching solution having a composition shown below, it was found that as in Example 2, a high bleaching efficiency was attained in the case of the compounds Nos. 1, 8, 13 and 16 of this invention and it was confirmed that a clear cyan dye image can be formed by employing the compound of this invention.

Composition of Bleaching Solution (treated at 30° C. for 1 minute and 30 seconds):

| | |
|---|---|
| Ferric citrate | 100 g |
| Ammonium bromide | 150 g |
| Ferric chloride | 73 g |
| Water | balance |
| Total | 1 liter |

EXAMPLE 4

Into a positive silver iodochlorobromide emulsion prepared according to a customary method was incorporated a suitable amount of a dispersion containing as a yellow coupler of α-pivalyl-α-[4-(4-benzyloxyphenylsulfonyl)phenoxy]-2-chloro-5-[α-(2,4-di-tert-amylphenoxy)-butylamido] acetoanilide to form a blue-sensitive emulsion for color photography. This emulsion was coated on a polyethylene-coated paper, and an intermediate layer composed of gelatin alone was formed on the emulsion layer by coating. Then, an orthosensitized silver chlorobromide emulsion containing a suitable amount of a dispersion of 1-(2,4-dimethyl-6-chlorophenyl)-3-[3-[α-(m-pentadecylphenoxy)butylamido]-benzanudi]-5-pyrazolone as a magenta coupler was coated on the intermediate layer. 4 sheets of the so obtained multi-layer photosensitive paper were prepared. Separately, the positive silver chlorobromide emulsion used in Example 2 was divided into 4 portions after second ripening thereof. No compound was added to one portion, and compounds of this invention indicated in Table 3 and a comparative compound C having a structure given below were added to the remaining 3 portions, respectively. The cyan coupler used in Example 2 was added to each of the so formed 4 emulsions, and thus were prepared 4 emulsions for color photography.

Comparative Compound C:

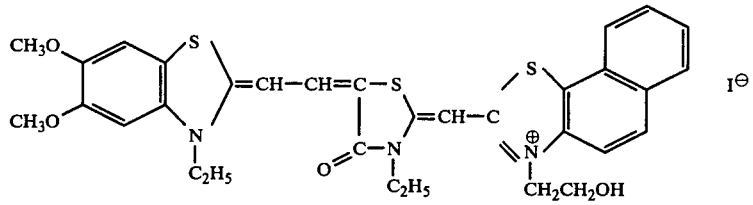

The so formed 4 emulsions for color photography were coated on the above 4 sheets of the multi-layer photosensitive paper, respectively, to obtain samples Nos. 13 to 15 and comparative sample No. 16. These samples were processed in the same manner as in Example 1. The density of the dye stain in the non-exposed areas was measured and the bleaching efficiency was evaluated by the manner that a dye forming the color image was decomposed by a concentrated hydrochloric acid, and then a maximum density of the residual silver image was measured. Obtained results are shown in Table 3.

Table 3

| Sample No. | Compound Kind | Compound Amount added (mg/kg emulsion) | Density of Color Stain | Bleaching Efficiency (residual silver image density) |
|---|---|---|---|---|
| 13 | — | — | 0.04 | 0.05 |
| 14 | Compound No. 8 | 40 | 0.04 | 0.05 |
| 15 | Compound No. 14 | 40 | 0.03 | 0.04 |
| 16 | Comparative Compound C | 40 | 0.08 | 0.09 |

From the results shown in Table 3, it is seen that in the case of the compounds Nos. 8 and 14 of this invention the density of the color stain was reduced and the bleaching efficiency was highly improved as compared with the case of the comparative compound. From the results of the measurement conducted after the above samples and comparative sample had been stored at a temperature of 50° C. and a relative humidity of 80% for 8 days, it was seen that in silver halide photosensitive materials for color photography prepared by employing the compounds Nos. 8 and 14 of this invention no degradation of photographic properties was observed, but in the sample prepared by employing the comparative compound C, the red-sensitivity was reduced and increased increase of cyan dye fogs was observed.

What is claimed is:

1. A method of bleaching an imagewise exposed and then developed silver halide photosensitive material for color photography, the photosensitive material comprising a red sensitive silver halide emulsion layer having, in an amount of 0.005 to 0.5 g per mole of silver halide, at least one of the compounds represented by the following general formula:

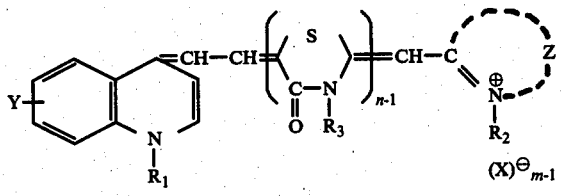

wherein $R_1$ and $R_2$ individually stand for substituted or unsubstituted alkyl; $R_3$ is alkyl or allyl; Y is hydrogen, halogen, alkyl or alkoxy; Z is a group of atoms necessary for forming a substituted or unsubstituted heterocyclic ring, said heterocyclic ring selected from the group consisting of thiazole, benzothiazole, naphthoselenazole, benzoselenazole, naphthothiazole, benzoxazole, and 1-3-dioxolo [4.5-f] benzothiazole; X is an anion; m and n are individually 1 or 2 provided that when m is 1, an inner salt is formed, said method comprising treating said photosensitive material with a bleaching or bleach-fixing solution containing an ethylenediamine tetraacetic acid iron complex salt.

2. A method according to claim 1 wherein the layer is a red-sensitive cyan-color-forming emulsion layer comprising a cyan coupler.

3. A method according to claim 1 wherein the solution further comprises sodium thiosulfate.

4. A method according to claim 1 wherein the solution further comprises a bleaching assistant.

5. A method according to claim 4 wherein the bleaching assistant is selected from the group consisting of potassium bromide, sodium bromide, sodium chloride, ammonium bromide, ammonium chloride, and potassium iodide.

* * * * *